US005296076A

United States Patent [19]

Morita

[11] Patent Number: 5,296,076

[45] Date of Patent: Mar. 22, 1994

[54] APPARATUS FOR APPLYING TAPE AND METHOD THEREFOR

[75] Inventor: Yoshikazu Morita, Tokyo, Japan

[73] Assignee: Mitsubishi Gas Chemical Company, Inc., Tokyo, Japan

[21] Appl. No.: 858,787

[22] Filed: Mar. 19, 1992

[30] Foreign Application Priority Data

Mar. 20, 1991 [JP] Japan ..... 3-81908

[51] Int. Cl.[5] ..... B32B 31/04

[52] U.S. Cl. ..... 156/361; 156/157; 156/502; 156/516; 156/538; 156/540; 156/543; 156/555

[58] Field of Search ..... 156/324, 157, 361, 502, 156/516, 538, 540, 543, 555

[56] References Cited

U.S. PATENT DOCUMENTS 4,132,583 1/1979 Hodgson ..... 156/361
4,231,835 11/1980 Ensley et al. ..... 156/361
4,907,393 3/1990 Omori et al. ..... 53/410
4,990,215 2/1991 Anderson ..... 156/540
4,995,937 2/1991 Persson ..... 156/543

FOREIGN PATENT DOCUMENTS 0325855 8/1989 European Pat. Off. .
1-111606 2/1989 Japan .
1-139303 5/1989 Japan .
88-04272 6/1988 PCT Int'l Appl. .

*Primary Examiner*—Caleb Weston
*Attorney, Agent, or Firm*—Leydig, Voit & Mayer

[57] ABSTRACT

An apparatus and a method for applying a tape on a belt-like member which is being fed continuously are disclosed in which a new tape loaded as a spare is delivered when the tape is depleted so as to continue the operation of applying the tape, so that the tape can be continuously stuck on the belt-like member by using several tapes while eliminating the necessity of stopping the operation of applying the tape onto the belt-like member.

32 Claims, 6 Drawing Sheets

APPARATUS FOR APPLYING TAPE AND METHOD THEREFOR

BACKGROUND OF THE INVENTION

1. Field of the Invention

The present invention relates to an apparatus and a method for continuously applying a tape. More particularly, the present invention relates to an apparatus and a method for continuously applying, for example, a double-coated tape with a separation sheet for use to secure freshness-keeping agents or desiccating agents on packing bags or the covers of packing containers for accommodating foods such as confections, delicacies, Chinese noodles, hams, salami, sausages and boiled rice to the freshness-keeping agents, the desiccating agents or a belt-like film for use to form the cover of the packing container.

2. Description of the Related Art

Hitherto, a freshness-keeping agent or a desiccating agent has been accommodated in a small bag which has usually and simply been accommodated in a container together with a food. Since the conventional freshness-keeping agent or the like has not been secured to the container, there arises a problem in that the consumers may be mislead to recognize the freshness-keeping agent as a food or places and cooks the freshness-keeping agent with the food on a frying pan or the like.

Accordingly, a method has been studied and employed in which a bag, which accommodates the freshness-keeping agent or the like, is secured to the packing bag or the container.

As a conventional method of securing the freshness-keeping agent or the like, a method in which heat sealing is utilized, a method in which a hot-melt material is used and a method in which a double-coated tape is employed have been widely used. The securing method arranged to use the double-coated tape comprises steps of: automatically supplying a series of bag members formed by continuously connecting the small bags for accommodating the freshness-keeping agent or the like; continuously applying the double-coated tape on the series of bag members; sectioning the series of bag members on which the double-coated tape has been applied and which accommodates the freshness-keeping agent or the like into each bag unit in synchronization with an apparatus to manufacture the packing bags or the packing containers; and respectively securing the thus obtained small bags to the packing bags or the inside portions of the packing containers. In this method, the double-coated tape having a predetermined width is wound around a reel by a predetermined length.

Hence, when a coil of the double-coated tape has been depleted, the following operations must be performed: the operation of the apparatus for applying the double-coated tape is stopped; the reel from which the double-coated tape has been completely depleted is changed for another reel to which a new double-coated tape is wound; and the double-coated tape is set to the commencement state in which the new double-coated tape wound around the reel can be applied on a continuous series of bags arranged in a belt-like configuration.

With the method in which the double-coated tape is used as described above, the operation of the apparatus for applying tape must be stopped whenever the double-coated tape wound around one reel has been depleted, and therefore all of the operations of the apparatus and the process of packing the foods must be stopped as well as stopping the apparatus for applying the tape. Therefore, the manufacturing efficiency has been excessively deteriorated and stopping the apparatus raises various problems.

SUMMARY OF THE INVENTION

Accordingly, an object of the present invention is to provide an apparatus for continuously applying a tape on a belt-like member. Another object of the present invention is to provide a method for continuously applying a tape on a belt-like member.

In order to achieve the aforesaid object, according to the present invention, a technique is disclosed for use in applying a tape on a two-sided belt-like member which is being fed continuously, in which a new tape loaded as a spare is delivered when the tape is depleted so as to continue the operation of applying the tape, so that the tape can be continuously stuck on the belt-like member by using a plurality of the tapes while eliminating the necessity of stopping the operation to apply the tape on the belt-like member.

An apparatus and a method according to the present invention are employed in a process of packing foods or the like in which bags which accommodate an oxygen scavenger, freshness-keeping agents or desiccating agents are, by means of adhesive tapes, applied on sheets or films for use as covers of containers. More particularly, the method utilizes a double-coated adhesive tape and a separation tape, and in operation, the separation sheet is removed or peeled off from the double-coated two-sided tape, and one side of the double-coated tape with the adhesive agent is applied on the sheet or the film and another side of the same is applied on the bag which accommodates the oxygen scavenger.

An apparatus for applying tape according to the present invention comprises: a belt-like member to be supplied continuously; first accommodating means for accommodating a tape; first applicator means for applying the first tape accommodated in the first accommodating means on the belt like member; first feeding means for feeding the first tape from the first accommodating means to the applicator means; second accommodating means for accommodating a spare or second tape; second applicator means for applying the spare tape accommodated in the second accommodating means on the belt-like member; second feeding means for feeding the spare tape accommodated in the second accommodating means to the second applicator means; and switching means for activating the second applicator means and the second feeding means to apply the second tape on the belt-like member when the first tape accommodated in the first accommodating means has been depleted.

In the embodiment of the present invention, detection means for detecting the depletion of the tape is provided if necessary, so that feeding and applying of the spare tape are performed depending upon the detection of the depletion of the tape.

It is preferable that the operations of the first applicator means and the feeding means for the tape which has been depleted be stopped simultaneously with activation of the second applicator means and the second feeding means.

When the tape is depleted, a new tape is supplied as the spare tape. By repeating this operation, the tape can be continuously applied on the belt-like member.

For example, a double-coated tape is used as the tape according to the present invention. The "double-coated tape" means a tape having opposite sides or surface on each of which an adhesive agent (or a pressure sensitive agent) is applied, at least one side having a separation sheet placed thereon. In particular, it is preferable that a double-coated tape having the separation sheet only on one side thereof be employed. The double-coated tape is wound around a reel and is rewound from the reel at the time of the operation.

The "belt-like member" means a member formed into a belt-like shape or a plate-like belt in which a plurality of bags accommodating an oxygen scavenger, a freshness-keeping agent or a desiccating agent are connected in one direction. The "plate-like belt" means a belt-like member in which a plurality of belt-like labels or belt-like stickers are connected to one another.

The aforesaid accommodating means may be a reel around which the tape is wound. The tape is fed from the reel so as to, through a guide roller serving as a feeding means for controlling the feeding direction and the position of the rewound tape and a tension roller for, if necessary, adjusting the looseness of the tape and the like, be supplied to one side of the belt-like member which is conveyed continuously. In a case where the double-coated tape is used, the side on which the separation sheet is not stuck is made to face the belt-like member.

The applicator means is composed of a pair of rollers which are always rotated and are capable of coming in contact with each other or moving away from each other. In a case where the tape is applied on the belt-like member, the belt-like member and the tape are conveyed through a space between the two rollers and the tape can be applied on the belt-like member by forcibly bringing the two rollers into contact with each other. A pair of rollers for applying the spare tape on the belt-like member are positioned away from each other until the spare tape is used.

The switching means according to the present invention switches the operation from the line for the depleted tape to the line for the spare tape, by, for example, bringing the pair of the application rollers for the spare tape into contact with each other and moving the same for the depleted tape away from each other.

The switching means includes an actuator for moving at least one of the pair of the rollers. The actuator is exemplified by a structure which is operated by at least any one of a spring, magnetic force, air pressure or hydraulic pressure. The aforesaid actuator is exemplified by an arm or a rod.

When the depletion of the tape is detected, depending upon a receipt of the detection signal transmitted from the detection means, the pair of the rollers of the applicator means are moved away from each other, and at the same time the pair of rollers of the spare tape applicator means are forcibly brought into contact with each other, so that application of the spare tape is commenced. The force for delivering the tape from the reel is obtained from the adhesive force generated at the time of applying the tape on the belt-like member which is being continuously conveyed.

The apparatus according to the present invention has means for continuously removing or peeling off the separation sheet from the double-coated tape. The method according to the present invention includes a process of removing the separation sheet from the double-coated tape. The peeling means comprises a separation guide roller for guiding the separation sheet which has been separated from the double-coated tape away from said double-coated tape, and a pair of discharging rollers for discharging the separation sheet from the separation guide roller to a chute for discharging the separation sheet. If necessary, a tension roller may be provided which eliminates the looseness of the separation sheet and gives it a predetermined tension. The discharging rollers may comprise a drive roller and an idling roller.

The separation sheet peeled off from the double-coated tape is, thus, sequentially conveyed through the aforesaid rollers and the chute so as to be discharged from the apparatus.

Similarly to the application rollers for applying the double-coated tape, the pair of discharging rollers are capable of selectively coming in contact with each other or moving away from each other. That is, at least one of the pair of the rollers is structured similarly to that of the aforesaid rollers so as to be capable of changing the position of the roller. The force for rotating the discharging rollers is obtained from a motor directly connected to the drive rollers. Usually, the aforesaid rollers are always rotated. The separation sheet is conveyed by the separation guide roller and through a space between the pair of the discharging rollers, and the two rollers are forcibly brought into contact with each other, so that the separation sheet can be continuously peeled off from the double-coated tape and discharged to the chute. Before use of the spare tape, the discharging rollers for the spare tape are positioned away from each other. When the detection signal denoting the depletion of the tape is received, the actuator is activated, so that the pair of the rollers which are discharging the separation sheet of the depleting tape are moved away from each other and another pair of the rollers for the spare tape are forcibly brought into contact with each other.

The spare tape is set along a line extending from the accommodating means, the feeding means and the applicator means, so that application of the spare tape can be performed immediately after the tape, which was being applied, has been depleted. Specifically, the leading portion of the spare tape accommodated by the reel extends through a space between the pair of application rollers and is placed in a slightly forward position in the lower stream from the application rollers. The separation sheet is peeled off from the tape, and the leading portion of the separation sheet is placed between the discharging rollers.

The depletion of the tape can be detected by, for example, detection means. A preferable example of the detection means may be a structure for transmitting a detection signal denoting the detection of the depletion of the tape when the diameter of the tape wound around the reel is reduced to a value smaller than a predetermined value. For example, a structure may be employed in which a light transmitter is provided on either side of the reel around which the tape is wound and a light receiver is provided on another side so as to cause the receiver to transmit a detection signal in response to the light which has passed through the tape when the diameter of the tape wound around the reel has been reduced. Another structure may be employed which receives reflected ultrasonic waves, or a structure which detects a change in the magnetism or a static capacity or a structure which uses a limit switch may be employed.

Simultaneously with or after a predetermined time from the receipt of the detection signal supplied from the detection means, the tape feeding means and the applicator means are stopped, and the spare tape feeding means and the applicator means are started. Simultaneously with or after a predetermined time from the receipt of the detection signal, the tape which is being almost depleted is cut, because, the inner end portion of the reeled tape consists only of the separation sheet. The tape which is almost depleted is cut at a position within a range of the flow of the tape from a position immediately after the tape extends from the reel to a position immediately before reaching the application rollers. Depending upon the aforesaid cutting position, timing at which the spare tape is fed after the receipt of the signal from the detector is determined.

The aforementioned various rollers may be unified by forming a plurality of guide grooves in one roller. For example, the separation guide roller for guiding the separation sheet and the roller for guiding the spare double-coated tape may be replaced by one common roller which has guide grooves running parallel to each other. The guide roller for guiding the double-coated tape which is being fed and the guide roller for guiding the spare double-coated tape may also be replaced by one common roller which has guide grooves running parallel to each other. The guide roller for guiding the separation sheet which is being peeled off and the separation guide roller for guiding the separation sheet of the spare double-coated tape may also be replaced by one common roller which has guide grooves running parallel to each other. When the structure, in which the common roller is used, is employed, the size of the apparatus can be reduced.

The operation of moving the pair of application rollers away from each other, the operation of moving the pair of separation guide rollers for guiding the separation sheet away from each other and the operation of forcibly bringing the pair of rollers for applying the spare tape into contact with each other to be performed when the tape is depleted may be automatically performed under the control carried out by a microcomputer to which the aforesaid detection signal is supplied. The aforesaid operations may alternatively be performed manually.

As described above, according to the present invention, the tape can be continuously applied on the belt-like member.

Other and further objects, features and advantages of the invention will appear more fully from the following description.

DESCRIPTION OF THE PREFERRED EMBODIMENTS

Figure 1:
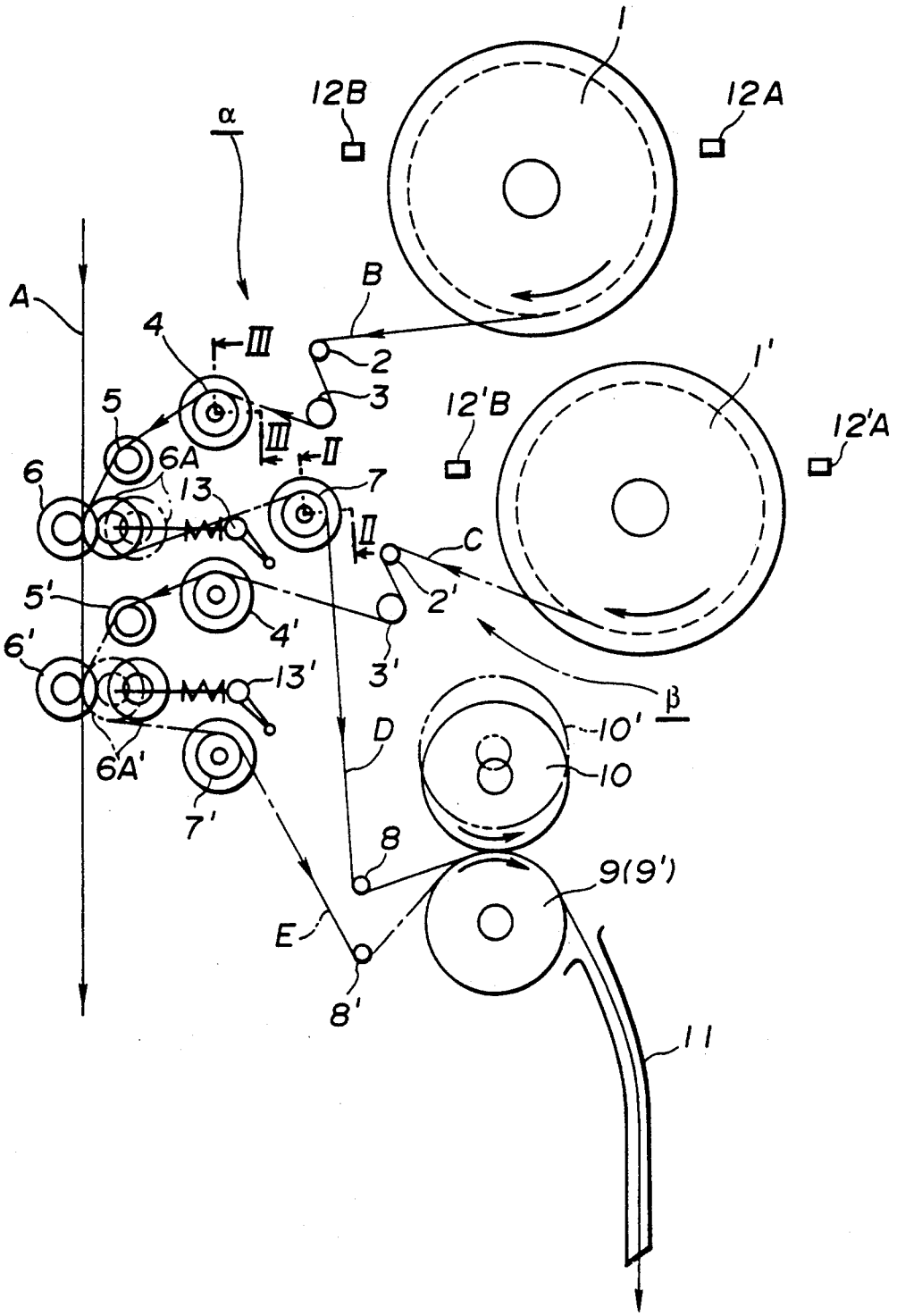
FIG. 1 is a schematic view which illustrates a first embodiment of the present invention.

Preferred embodiments of the present invention will now be described with reference to the drawings.

An apparatus for applying tape according to the present invention has a mechanism (omitted from illustration) for continuously supplying a belt-like member A. A system for feeding and applying the double-coated tape on the belt-like member A is composed of lines $\alpha$ and $\beta$. One of the two lines is in an operational state in which the tape is being fed and applied, while another line is in a waiting state for next tape feeding and applying operations. Each line comprises: unreels 1 and 1' to which double-coated tapes B and C each having a separation sheet stuck on one side thereof are respectively wound; and guide bars 2 and 2' for guiding the surface of the double-coated tape on which the separation sheet is applied. The line further comprises: friction rollers for guiding the surface of the double-coated tape on which an adhesive agent is applied and eliminating looseness of the double-coated tape at the time of feeding to give a tension to the double-coated tape; and guide rollers 4 and 4' for guiding the double-coated tape in the feeding direction in which the same is applied on the belt-like member A. The line further comprises: position restricting rollers 5 and 5' for restricting the final position at the time of applying the double-coated tape on the belt-like member A; and application rollers 6 and 6' each of which is composed of a pair of stationary roller (6) (6') and a movable roller 6A (6'A) to apply the adhesive side of the double-coated tape having no separation sheet on the belt-like member A by forcibly pressing the double-coated tape between the two rollers 6 and 6A. The line further comprises: separation sheet guide rollers 7 and 7' for, in the feeding direction, guiding the separation sheets D and E peeled off from the double-coated tape; and tension rollers 8 and 8' for eliminating looseness of the separation sheets D and E to give them a predetermined tension. The line further comprises: drive rollers 9 and 9' to which a motor is directly connected so as to be rotated for the purpose of continuously delivering the separation sheet; idle rollers 10 and 10' disposed to correspond to the drive rollers 9 and 9'; and delivering chute 11 for exhausting the separation sheet, the delivering chute 11 being commonly used by the two lines. The pair of drive rollers 9, 9' and opposed idle rollers 10, 10' defines discharging rollers.

Figure 2:
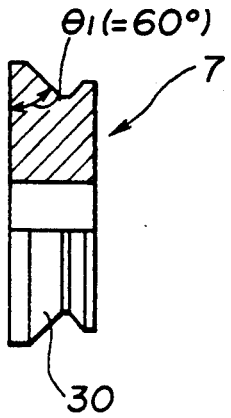
FIG. 2 is a cross sectional view taken along line II—II of FIG. 1.
Figure 3:
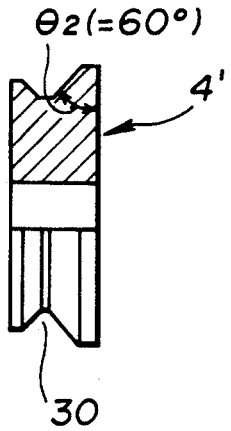
FIG. 3 is a cross sectional view taken along line III—III of FIG. 1.

FIG. 2 is cross sectional view taken along line II—II of FIG. 1 and illustrating the cross sectional shape of a half portion of the separation guide roller 7. FIG. 3 is a cross sectional view taken along line III—III of FIG. 1 and illustrating the cross sectional shape of a half portion of the guide roller 4 for guiding the double-coated tape. The aforesaid rollers have guide grooves 30 which come in contact with the double-coated tape or the separation sheet.

The aforesaid movable roller 6A (6'A) of the pair of application rollers 6 (6') can be moved to or away from the stationary roller by a slide lever 13 (13'). The pair of application rollers 6 and 6A are brought into contact with each other to apply the double-coated tape on the belt-like member in a space between the two rollers. Another pair of the application rollers 6' and 6'A which are not in operation are moved away from each other.

Also the idle roller 10 (10') is able to move toward the drive roller 9 (9') in such a way that they come in contact with each other at the time of discharging the separation sheet from the double-coated tape to deliver the separation sheet positioned between the idle roller and the drive roller to the chute. When an operation of peeling off the separation sheet is not performed, the aforesaid rollers are moved away from each other, and thus, feeding of the separation sheet is not performed.

The idle roller and the drive roller are provided for each of the lines $\alpha$ and $\beta$. The idle rollers omitted from the illustrations are disposed perpendicularly to the drawings sheet. Also the drive rollers are arranged similarly.

The surface of each of the friction rollers 3 and 3' is brought into contact with the surface of the double-coated tape on which the separation sheet is not stuck but the adhesive agent is applied. In order to prevent adhesion of the double-coated tape to the surface of the roller which will cause a difficulty in feeding the tape, a slit-like groove is formed in the surface of the friction roller. The slit-like groove also enables a braking effect to be obtained at the time of feeding the double-coated tape.

The separation guide rollers 7 and 7' adjust the direction in which the separation sheet is removed in order to smoothly peel off the separation sheet from the double-coated tape. The idle rollers 10 and 10' press the separation sheet to the drive rollers 9 and 9' to deliver the separation sheet, while causing the drive rollers 9 and 9' to pull the separation sheet by the rotational force of the drive rollers 9 and 9'. Thus, feeding of the separation sheet is performed by a degree corresponding to the looseness of the separation sheet, so that the separation sheet is delivered.

Assuming that the double-coated tape B is to be applied on the belt-like member A and the double-coated tape C is the spare tape, the double-coated tape B is unwound from the unreel 1 and is extended through the guide bar 2, the friction roller 3, the guide roller 4 and the position restricting roller 5, to a position immediately before the application roller 6.

The double-coated tape B is forcibly brought into contact with the belt-like member A when it passes through the pair of the rollers 6, so that the adhesive side of the double-coated tape B is applied on the belt-like member A. The separation sheet D placed on the opposing side of the double-coated tape B is peeled off from the double-coated tape B when it passes through the application roller 6. Then, the feeding direction of the separation sheet D is guided by the separation guide roller 7. The looseness generated due to the excess portion of the separation sheet D is absorbed by the tension roller 8. Then, the separation sheet D is further fed by the drive roller 9 and the idle roller 10 brought into contact with the drive roller 9, so that the separation sheet is discharged through the guide chute 11.

The force for feeding the double-coated tape from the reel can be obtained from a fact that the double-coated tape is conveyed integrally with the belt like member taken place due to application of the double-coated tape on the belt-like member which is being continuously supplied.

The spare tape C is delivered from the unreel 1' and passes through the guide bar 2', the friction roller 3', the guide roller 4' and the position restricting roller 5', and further through the pair of the rollers 6' moved away from each other. The separation sheet E is peeled off from the double-coated spare tape C immediately after the double-coated tape has been passed through the roller 6', and only the separation sheet E further extends through the separation guide roller 7' and the tension roller 8'. Then, it is further conveyed through the space between the drive roller 9' and the distanced idle roller 10', and the leading portion of the separation sheet is introduced into the guide chute 11, so that the line of the space tape C and E are in a waiting state ready for the operation of applying the double-coated tape and the discharge of the separation sheet.

Light oscillators 12A and 12'A are disposed on either side of the unreels 1 and 1', while light receivers 12B and 12'B are disposed on another side of the same. The intensity of transmitted light is previously adjusted so as to transmit the light from the light oscillators through the tape to the light receivers simultaneously or immediately before the double-coated tape is depleted after the operation of applying the double-coated tape on the belt-like member has been proceeded with and the diameter of the double-coated tape has been reduced.

Immediately before the depletion of the double-coated tape loaded on the line which is being operated, a detection signal is transmitted from the aforesaid light receiver 12B. In response to a control signal transmitted from a microcomputer (omitted from illustration) which has received the aforesaid signal, the slide bar 13 is operated to move the movable roller 6A away from the stationary roller of the application rollers 6 and the idle roller 10 of the discharging rollers is moved away from the drive roller 9. At this time, the double-coated tape B is cut at a position immediate after the double-coated tape B has been conveyed through the reel 1. The aforesaid cutting operation may be performed manually or by using a cutting device which receives a control signal transmitted from the microcomputer.

Simultaneously with the receipt of the detection signal transmitted from the light receiver 12B, the movable roller 6'A of the application roller 6' is forcibly brought into contact with the stationary roller and the idle roller the discharging rollers 10' is pressed against the drive roller 9'. As a result, the operation of applying the spare double-coated tape C on the belt-like member A is commenced and simultaneously the discharge of the separation sheet E of the double-coated tape D is commenced.

During the operation of applying the spare tape C, another unreel 1 to which a new double-coated tape (the spare tape) is wound is set while setting the double-coated tape and the separation sheet to predetermined positions by the aforesaid method. When the double-coated tape C wound around the unreel 1' is depleted, switching to application of the double-coated tape from the unreel 1 is performed. By repeating the aforesaid operation, the tape can be continuously applied on the belt-like member while eliminating the necessity of stopping the tape applying operation. When the double-coated tape to be applied on the belt-like member is switched, the tape which is being applied on the belt-like member and the spare tape may be connected to each other by applying their superposed end portions on the surface of the belt-like member or by applying them on the surface of the belt-like member while making them run parallel and eliminating the operation of applying them.

Although the aforesaid embodiment is arranged in such a way that the aforesaid various rollers are respectively provided for the lines $\alpha$ and $\beta$, a roller of one line and a roller of the other line may be replaced by one common roller having a plurality of guide grooves formed thereon.

As shown in FIGS. 2 and 3, the side surface of the guide roller 7 and that of the guide roller 4' are slanted in opposite directions from each other, so that the separation sheet D delivered from the guide roller 7 and the tape C, which is being fed to the guide roller 4', are moved diagonally in opposite directions and thereby their intersection can be prevented. As a result, both of the double-coated tape and the separation sheet can be fed smoothly. The angle ($\theta_1$) of the guide roller and the angle ($\theta_2$) of the guide roller 4' may be $\theta_1=\theta_2=60°$. However. the present invention is not limited to this. For example, they may be different values or another selected values.

Figure 4:
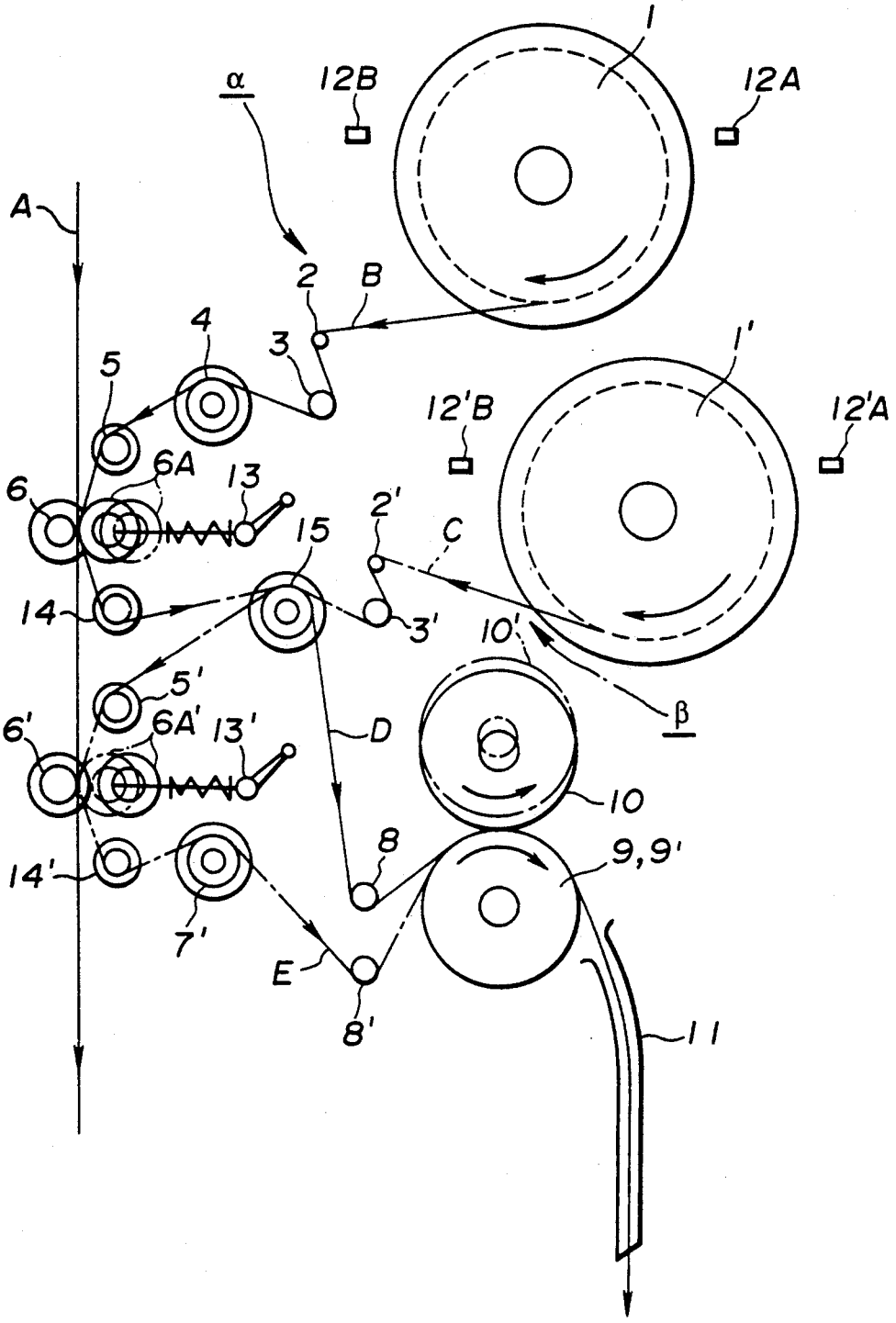
FIG. 4 is a schematic view which illustrates a second embodiment of the present invention.
Figure 5:
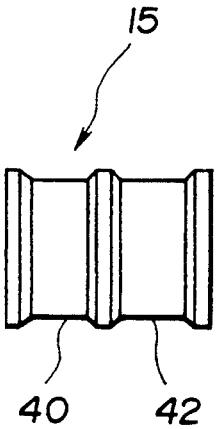
FIG. 5 is a side elevational view which illustrates a common roller formed by integrating a guide roller 7 and a guide roller 4'.

FIG. 4 illustrates an apparatus according to a second embodiment in which, for example, the guide roller 7 for guiding the separation sheet D and the guide roller 4' for guiding the double-coated tape C is replaced by a common roller 15. The guide roller 15 has, as shown in FIG. 5, guide grooves 40 and 42 running parallel so as to cause the double-coated tape to be conveyed through either groove and the separation sheet to be conveyed through the other groove. As a result of the arrangement made as shown in FIG. 4, the number of the rollers can be decreased and the size of the apparatus can be reduced. The apparatus shown in FIG. 4 further comprises separation sheet position restricting rollers 14 and 14' for restricting the directions in which the separation sheets D and E are fed, so that the direction in which the separation sheets are fed with respect to the guide rollers 15 and 7' can be restricted. As a result, the separation sheet can be smoothly discharged. The guide groove 40 and the guide groove 42 of the guide roller 15 shown in FIG. 5 can be rotated in opposite directions depending on which line is in operation, because the double-coated tape C and the separation sheet D are fed in opposite directions.

Figure 6:
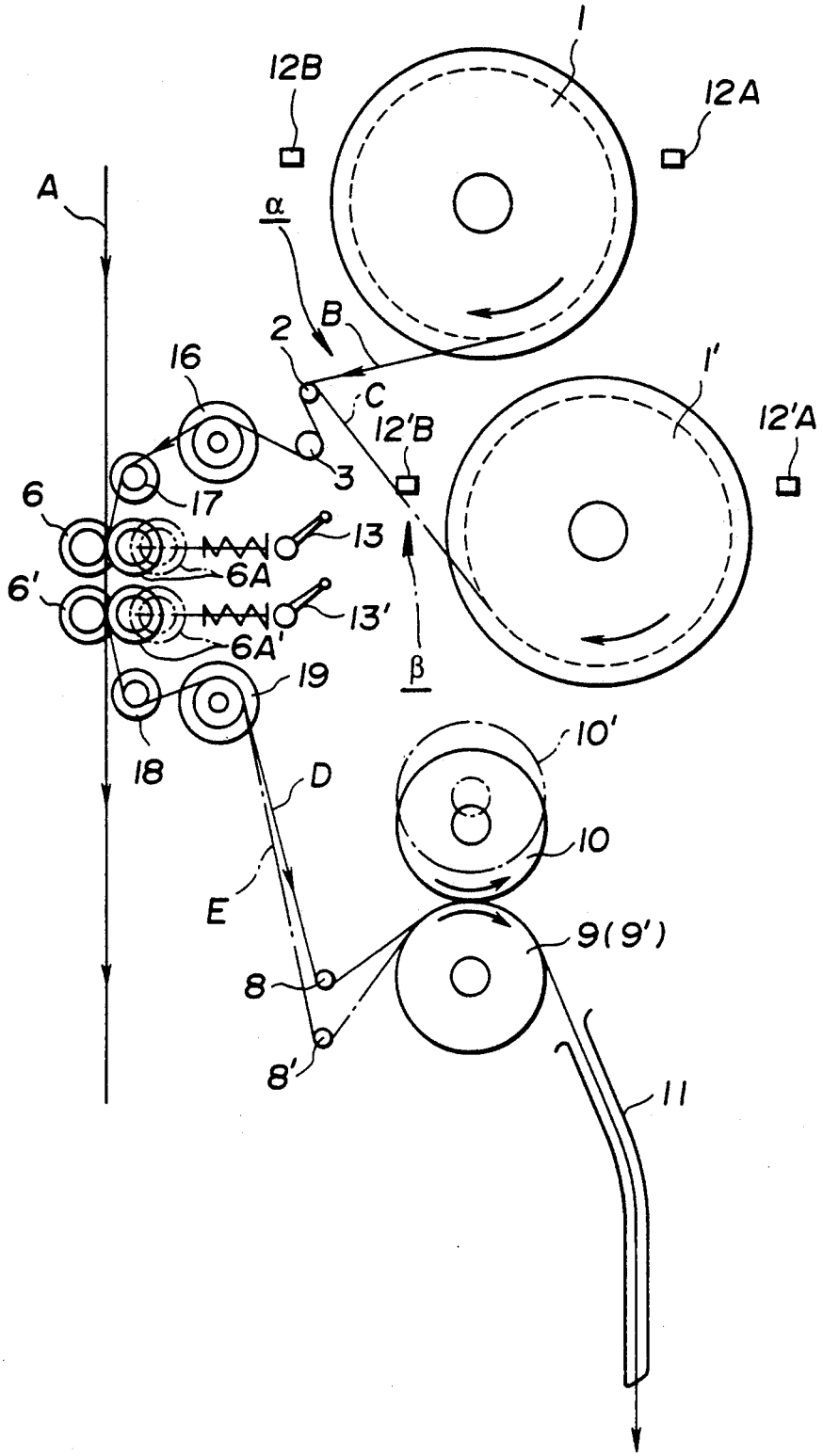
FIG. 6 is a schematic view which illustrates a third embodiment of the present invention.
Figure 7:
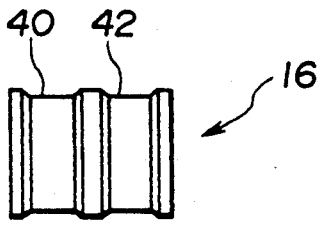
FIG. 7 is a side elevational view which illustrates a common roller which performs the operations of a guide roller 4 and the guide roller 4'.
Figure 8:
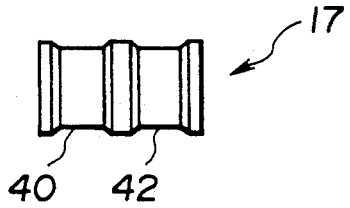
FIG. 8 is a side elevational view which illustrates a common roller formed by integrating position restricting rollers 5 and 5' for restricting the positions of double-coated tapes B and C.
Figure 9:
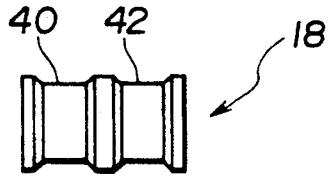
FIG. 9 is a side elevational view which illustrates a common roller formed by integrating position restricting rollers 14 and 14' for restricting the positions of the separation sheets D and E.
Figure 10:
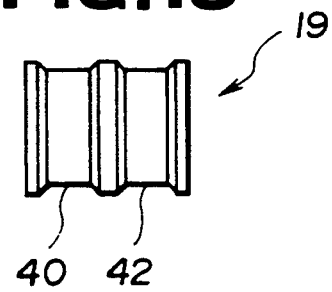
FIG. 10 is a side elevational view which illustrates a common roller formed by integrating guide rollers 7 and 7' for guiding the separation sheets D and E.

FIG. 6 illustrates a third embodiment in which rollers except for the aforesaid application rollers 6 and 6', the idler rollers 10 and 10', the tension rollers 8 and 8' and the drive rollers 9 and 9' are replaced by corresponding common rollers. FIG. 7 is a side elevational view which illustrates a roller 16 serving as a common roller used in place of the guide roller 4 for guiding the double-coated tape B which is being fed and the guide roller 4' for guiding the double-coated tape C which is being fed. FIG. 8 is a side elevational view which illustrates a roller 17 formed by integrating the position restricting rollers 5 and 5' for the double-coated tapes B and C. FIG. 9 is a side elevational view which illustrates a roller 18 formed by integrating the position restricting rollers 14 and 14' for the separation sheets D and E. FIG. 10 is a side elevational view which illustrates a roller 19 formed by integrating the guide rollers 7 and 7' for the separation sheets D and E. Each of the aforesaid rollers has guide grooves 40 and 42 formed to run parallel so as to cause the double-coated tape or the separation sheet to be conveyed through either groove. The structure according to the aforesaid embodiment will enable an effect to be obtained in that the size of the apparatus can be reduced.

The detection means is not limited to the aforesaid detector. For example, it may be structured in this way that the length of the tape is previously set in a storage device of a microcomputer, the microcomputer calculates the length of the tape which has been fed and transmits a detection signal at the moment at which the tape has been depleted. The method of detecting the depletion of the tape by means of the detector will enable the depletion of the tape to be easily detected even if the tape has a different length.

Although the aforesaid embodiments have two lines for feeding the double-coated tapes to apply them on the belt-like members, three or more lines may be provided. Furthermore, switching to the spare tape may be performed manually. In addition, the depletion of the tape may be detected visually.

The apparatus according to the aforesaid embodiments will cause the following effect to be obtained in a method in which a series of bag members, each accommodating a freshness-keeping agent, a desiccating agent or an oxygen scavenger, is automatically supplied, a double-coated tape is applied on the series of bag members, the series of bag members are sectioned into small bags and each bag is secured to the inner surface of the packing bag or the inner surface of the cover of the container: the double-coated tape can be continuously applied while eliminating the necessity of stopping the operation of applying the double-coated tape for switching the double-coated tape after the double-coated tape has been depleted. As a result, the necessity of stopping the process of packing foods and the freshness-keeping agent, and the apparatus therefor can be eliminated. Consequently, the packing operation can be performed significantly effectively and, therefore, the cost required to pack the foods can be satisfactorily reduced.

Although the invention has been described in its preferred form with a certain degree of particularly, it is understood that the present disclosure of the preferred form may be changed in the details of construction and an alternate combination and arrangement of parts may be resorted to without departing from the spirit and the scope of the invention as hereinafter claimed.

What is claimed is:

1. An apparatus for applying tape to a belt-like member supplied continuously comprising:

(A) a first accommodating means for accommodating a first double-coated, two-sided tape having a separation sheet on a first side thereof;

(B) a first applicator means for applying the second side of the first two-sided tape accommodated by said first accommodating means to a belt-like member;

(C) a first feeding means for feeding the first two-sided tape from said first accommodating means to said first applicator means;

(D) a first sheet removing means for removing the separation sheet from the first side of the first two-sided tape;

(E) a second accommodating means for accommodating a second double-coated, two-sided tape having a separation sheet on a first side thereof;

(F) a second applicator means for applying the second side of the second two-sided tape accommodated in said second accommodating means to a belt-like member;

(G) a second feeding means for feeding the second two-sided tape accommodated in said second accommodating means to said second applicator means;

(H) a second sheet removing means for removing the separation sheet from the first side of the second two-sided tape, each of said first and second sheet removing means including:

(i) a separation guide roller for guiding the separation sheet separated from said double-coated, two-sided tape away from the double-coated, two-sided tape;

(ii) a pair of feeding rollers which selectively substantially contact each other in a first position to engage and feed the separation sheet therebetween and move away from each other to a second position to stop feeding the separation sheet; and (iii) a chute for discharging the separation sheet from said pair of feeding rollers; and (H) a switching means for activating said second applicator means, said second feeding and said second sheet removing means to apply the second double-coated tape to the belt like member when the supply of the first double-coated tape applied to the belt-like member by said first applicator means is depleted, said switching means including an actuator which actuates said feeding rollers of said first sheet removing means to move from the first position to the second position and said feeding rollers of said second sheet removing means to move from said second position to said first position when the double-coated tape applied to the belt-like member by said first applicator means is depleted.

2. An apparatus for applying tape according to claim 1, further comprising detection means for detecting the depletion of said tape.

3. An apparatus for applying tape according to claim 2, wherein said switching means stops the operations of said first applicator means and said first feeding means, and simultaneously activates said second applicator means and said second feeding means.

4. An apparatus for applying tape according to claim 2, wherein the two-sided tape which is being fed is cut at a position immediately before depletion in response to a detection signal transmitted from said detection means.

5. An apparatus for applying tape according to claim 2, wherein said accommodating means is a reel around which said tape is wound and said detection means transmits a detection signal denoting that the tape has been depleted when the diameter of the wound tape has been reduced to a value smaller than a predetermined value.

6. An apparatus for applying tape according to claim 5, wherein said detection means is a photoelectric tube.

7. An apparatus for applying tape according to claim 1, wherein a new double-coated, two-sided tape is accommodated in either of said first accommodating means or said second accommodating means from which said first or second double-coated, two-sided tape has been depleted and said new double-coated, two-sided tape is removed from its respective accommodating means when the tape applied to the belt-like member is depleted from either of said first or second accommodating means.

8. An apparatus for applying tape according to claim 1, wherein the belt-like member is formed into a belt-like shape in which a plurality of bags accommodating at least any one of an oxygen scavenger, a freshness-keeping agent or a desiccating agent are connected in one direction.

9. An apparatus for applying tape according to claim 1, wherein the belt-like member is formed into a belt-like shape formed by connecting a plurality of belt-like labels or belt-like stickers.

10. An apparatus for applying tape according to claim 1, wherein each of said first and second sheet removing means has a guide roller for controlling the feeding direction and the position of the two-sided tape, and said first guide roller of said first feeding means and said separation guide roller of said second sheet removing means are formed into one roller having guide grooves running parallel to each other.

11. An apparatus for applying tape according to claim 1, wherein said separation guide roller of said first sheet removing means and said separation guide roller of said second sheet removing means comprise one roller having guide grooves running parallel to each other.

12. An apparatus for applying tape according to claim 1, wherein each of said first and second applicator means has a pair of application rollers which selectively substantially contact each other in a first position to convey the belt-like member and the two-sided tape through a space therebetween and apply the two-sided tape to the belt-like member by forcibly causing the two-sided tape and belt-like member to contact each other and move away from each other to a second position to stop said conveying and applying operation and, wherein said switching means includes an actuator which causes said first application rollers of said first applicator means to move to said second position and said second application rollers of said second applicator means to move to said first position when said double-coated tape is depleted.

13. An apparatus for applying tape according to claim 12, wherein said second two-sided, double-coated tape is conveyed through a space between said pair of application rollers of said second applicator means, which are positioned away from each other, the leading portion of said second double-coated tape is positioned at a slightly forward position of said second application rollers, said separation sheet is removed from said spare double-coated tape and said separation sheet is disposed between said pair of feeding rollers of said second applicator means, which are positioned away from each other.

14. An apparatus for applying tape according to claim 2, wherein each of said first and second feeding means has a guide roller for controlling the feeding direction and the position of said tape.

15. An apparatus for applying tape according to claim 14, wherein said guide roller of said first feeding means and said guide roller of said second feeding means comprises one roller having guide grooves running parallel to each other.

16. An apparatus for applying tape to a belt-like member supplied continuously comprising:

(A) a first accommodating means for accommodating a first tape;

(B) a first applicator means for applying the first tape accommodated by said first accommodating means to a belt-like member;

(C) a first feeding means for feeding the first tape from said first accommodating means to said first applicator means;

(D) a second accommodating means for accommodating a second tape;

(E) a second applicator means for applying the second tape accommodated in said second accommodating means to a belt-like member;

(F) a second feeding means for feeding the second tape accommodated in said second accommodating means to said second applicator means; and (G) a switching means for activating said second applicator means and said second feeding means to apply said second tape on said belt-like member when said first tape accommodated in said first accommodating means has been depleted, wherein each of said first and second applicator means has a pair of application rollers which selectively substantially contact each other in a first position to convey the belt-like member and the tape through a space therebetween and apply the tape to the belt-like member by forcibly causing the tape and belt-like member to contact each other and move away from each other to a second position to stop said conveying and applying operation and said switching means includes an actuator which causes said first application rollers of said first applicator means to move to said second position and said second application rollers of said second applicator means to move to said first position when said double-coated tape is depleted.

17. An apparatus for applying tape according to claim 16, wherein a new tape is accommodated in either of said first accommodating means or said second accommodating means from which tape has been depleted and said new tape is made to be the second tape.

18. An apparatus for applying tape according to claim 16, wherein the belt-like member is formed into a belt-like shape in which a plurality of bags are connected in one direction, each bag accommodating at least one of an oxygen scavenger, a freshness-keeping agent or a desiccating agent.

19. An apparatus for applying tape according to claim 16, wherein the belt-like member has a belt-like shape formed by connecting a plurality of belt-like labels or belt-like stickers.

20. An apparatus for applying tape according to claim 16, wherein said second double-coated tape is conveyed through a space between said pair of application rollers of said second applicator means, which are positioned in said second position, the leading portion of the second double-coated tape is positioned at a slightly forward position of said second application rollers, the separation sheet is removed from the second double-coated tape and the separation sheet is disposed between said pair of feeding rollers of said second sheet removing means, which are positioned in said second position.

21. An apparatus for applying tape according to claim 16, further comprising detection means for detecting the depletion of said tape.

22. An apparatus for applying tape according to claim 21, wherein said switching means stops the operations of said first applicator means and said first feeding means, and simultaneously activates said second applicator means and said second feeding means.

23. An apparatus for applying tape according to claim 21, wherein the tape which is being fed is cut at a position immediately before depletion in response to a detection signal transmitted from said detection means.

24. An apparatus for applying tape according to claim 21, wherein said accommodating means is a reel around which said tape is wound and said detection means transmits a detection signal denoting that the amount of tape remaining has been reduced to a value smaller than a predetermined value.

25. An apparatus for applying tape according to claim 24, wherein said detection means is a photoelectric tube.

26. An apparatus for applying tape according to claim 16, wherein each of said first and second feeding means has a guide roller for controlling the feeding direction and the position of the tape.

27. An apparatus for applying tape according to claim 26, wherein said guide roller of said first feeding means and said guide roller of said second feeding means comprises one roller having guide grooves running parallel to each other.

28. An apparatus for applying tape according to claim 16, wherein each tape is a double-coated tape having a separation sheet on one side thereof and said first and second applicator means apply the other side of the double-coated tape on which said separation sheet is not provided.

29. An apparatus for applying tape according to claim 28, further comprising a first sheet removing means for removing the separation sheet from the first double-coated tape applied to the belt-like member and a second sheet removing means for removing the separation sheet when the second double-coated tape is applied to the belt-like member.

30. An apparatus for applying tape according to claim 29, wherein each of said first and second sheet removing means comprises a separation guide roller for guiding the separation sheet separated from the double-coated tape away from the double-coated tape; a pair of feeding rollers which selectively substantially contact each other in a first position to engage and feed the separation sheet or move away from each other in a second position to stop feeding the separation sheet; and a chute for discharging the separation sheet from said feeding rollers, and wherein said switching means includes an actuator which actuates said feeding rollers of said first sheet removing means to move to said second position and said discharging rollers of said second sheet removing means to move to said first position when the double-coated tape is depleted.

31. An apparatus for applying tape according to claim 30, wherein each of said first and second feeding means has a guide roller for controlling the feeding direction and the position of the tape, and said first guide roller of said first feeding means and said separation guide roller of said second sheet removing means are formed into one roller having guide groove running parallel to each other.

32. An apparatus for applying tape according to claim 30, wherein said separation guide roller of said first sheet removing means and said separation guide roller of said second peeling means comprise one roller having guide grooves running parallel to each other.

* * * * *

UNITED STATES PATENT AND TRADEMARK OFFICE

CERTIFICATE OF CORRECTION

PATENT NO. : 5,296,076
DATED : March 22, 1994
INVENTOR(S) : Morita

It is certified that error appears in the above-indentified patent and that said Letters Patent is hereby corrected as shown below:

Column 11, line 24, after "feeding" insert --means--;

Column 11, line 26, change "belt like" to --belt-like--;

Column 12, line 60, change "comprises" to --comprise--;

Column 14, line 22, change "comprises" to --comprise--.

Signed and Sealed this

Twentieth Day of September, 1994

Bruce Lehman

*Attest:*

BRUCE LEHMAN

*Attesting Officer*

*Commissioner of Patents and Trademarks*